US006487736B1

(12) United States Patent
Militzer

(10) Patent No.: US 6,487,736 B1
(45) Date of Patent: Dec. 3, 2002

(54) HEAD SUPPORT

(76) Inventor: George Militzer, 1402 Carleton Sq., San Diego, CA (US) 92106

( * ) Notice: Subject to any disclaimer, the term of this patent is extended or adjusted under 35 U.S.C. 154(b) by 0 days.

(21) Appl. No.: 09/753,987

(22) Filed: Jan. 3, 2001

(51) Int. Cl.[7] ..... A47G 9/00; A42B 1/06

(52) U.S. Cl. ..... 5/636; 5/637; 5/640; 128/858

(58) Field of Search ..... 5/636, 637, 638, 5/639, 640, 643, 645, 622, 631, 490, 496, 498, 692; 128/857, 858, 869, 870

(56) References Cited

U.S. PATENT DOCUMENTS

| | | | | | |
|---|---|---|---|---|---|
| 2,810,920 | A | * | 10/1957 | Carruth | 5/636 X |
| 3,118,152 | A | * | 1/1964 | Talley, Jr. | 5/636 X |
| 3,276,046 | A | * | 10/1966 | Capelli | 5/639 |
| 3,988,793 | A | * | 11/1976 | Abitbol | 601/11 |
| 4,021,872 | A | * | 5/1977 | Powell | 5/722 |
| 4,040,133 | A | * | 8/1977 | Gilreath | 5/669 |
| 4,235,472 | A | * | 11/1980 | Sparks et al. | 5/640 X |
| 4,488,323 | A | * | 12/1984 | Colburn | 5/496 X |
| D278,779 | S | * | 5/1985 | Sink | D6/596 |
| 4,737,999 | A | * | 4/1988 | Halverson | 5/710 |
| 4,757,983 | A | | 7/1988 | Ray et al. | 269/328 |
| 4,768,246 | A | * | 9/1988 | Summer | 5/636 X |
| 4,819,287 | A | * | 4/1989 | Halverson | 5/710 |
| 4,867,178 | A | | 9/1989 | Smith | 128/858 |
| 4,899,407 | A | * | 2/1990 | McCue | 5/658 |
| 4,979,251 | A | * | 12/1990 | Lazar | 5/496 |
| 5,099,533 | A | * | 3/1992 | Bland | 5/490 |
| 5,103,516 | A | * | 4/1992 | Stevens | 5/640 |
| 5,163,195 | A | | 11/1992 | Hill | 5/637 |
| 5,177,823 | A | | 1/1993 | Riach | 5/636 |
| 5,214,815 | A | | 6/1993 | Agbodoe et al. | 5/637 |
| 5,269,035 | A | | 12/1993 | Hartunian | 5/638 |
| 5,360,017 | A | * | 11/1994 | Austin | 5/640 |
| 5,367,729 | A | * | 11/1994 | Lazar et al. | 5/496 X |
| 5,400,449 | A | * | 3/1995 | Satto | 5/631 |
| 5,504,953 | A | * | 4/1996 | Singer-Leyton et al. | 5/631 |
| 5,528,784 | A | * | 6/1996 | Painter | 5/636 X |
| 5,546,619 | A | | 8/1996 | Braun | 5/638 |
| 5,572,754 | A | * | 11/1996 | Lazar et al. | 5/496 X |
| 5,632,050 | A | * | 5/1997 | Zajas et al. | 5/640 X |
| 5,642,543 | A | * | 7/1997 | Huntley | 5/640 |
| 5,781,947 | A | * | 7/1998 | Sramek | 5/636 |
| 5,860,174 | A | * | 1/1999 | Failor | 5/81.1 HS |
| 5,926,880 | A | * | 7/1999 | Sramek | 5/636 |
| 5,970,546 | A | | 10/1999 | Danis et al. | 5/636 |
| 6,006,380 | A | * | 12/1999 | Sramek | 5/636 |
| 6,009,579 | A | * | 1/2000 | Pedersen | 5/690 |
| 6,154,905 | A | * | 12/2000 | Frydman | 5/648 |
| 6,182,314 | B1 | * | 2/2001 | Frydman | 5/648 |
| 6,230,349 | B1 | * | 5/2001 | Silver et al. | 5/636 |
| 6,233,764 | B1 | * | 5/2001 | Orr | 5/496 |

FOREIGN PATENT DOCUMENTS

| | | | | |
|---|---|---|---|---|
| GB | 14908 | * | 7/1898 | 5/498 |

OTHER PUBLICATIONS

A2Z, CORP Advertisement; e–mail address: A2ZCORP@AOL.COM; 2 pages.

* cited by examiner

*Primary Examiner*—Robert G. Santos
(74) *Attorney, Agent, or Firm*—Frank G. Morkunas

(57) ABSTRACT

A head support designed to maintain a face-down position for a user during post-operative care after eye surgery. The head support is wearable like a hat, has a removable liner, is cushioned to protect the head and eye, is adjustable to head size, is adjustable to height in use, is securely retainable on a user's head, and is adapted to prevent side to side rocking or tipping over.

26 Claims, 4 Drawing Sheets

HEAD SUPPORT

CROSS REFERENCES TO RELATED APPLICATIONS

None.

STATEMENT REGARDING FEDERALLY-SPONSORED RESEARCH OR DEVELOPMENT

None.

BACKGROUND OF THE INVENTION

This present invention relates to an improvement in head rests or supports, and more particularly to head supports used in post-operative situations which require face-down and virtual head-immobility to ensure a patient remains in a mandatory face-down position after certain surgeries.

Following certain eye-related surgical procedures, post-operative care will require that the patient maintain a face-down position for several days; even up to two weeks. In some retinal surgery this is generally required to ensure proper alignment and re-attachment of the retina. It is very difficult to maintain such a position while sleeping or while awake and either sitting or attempting to read. Most relevant prior art head support devices are either very complex, are uncomfortable, or fail to properly accommodate the wearer such that the wearer can maintain the proper face-down position and still enjoy some degree of flexibility and a respectable quality-of-life.

Several of these prior art supports generally require a user to rest the user's face directly onto a cushion or similar structure which has a large hole defining a breathing channel or pathway for one's nose and/or mouth as necessary. In some the hole is large enough to accommodate the eyes and the concomitant ability to see through the hole with the eye which has not undergone surgery. However, what the user would see generally is the table or pillow, for example, upon which the cushion or support sits; which is basically just a few inches from the eyes. Generally, these cushion or support devices require the user to place the user's forehead on the top part of the device and the chin on the bottom part of the device with the hole being in between. These devices make no accommodation for an eye patch or eye dressing which is worn or applied to a patient after eye surgery. Placing one's face into a hole such as this would pull on the dressing or pull on the eye patch or pull on the patient's skin or any combination thereof. This would cause pain or discomfort or both to or near the surgery site.

Some devices have legs or other support members around the perimeter of the device to lift the device from the table, for example, upon which it rests to thereby establish a better breathing channel for the user and/or a pathway for eating and drinking. Particular reference is made here to prior art U.S. Pat. No. 5,269,035 and the M.A.T.™ device offered by the ATOZ CORP on its website listed as Item MU17501, a copy of which has been included with this application.

These, and other prior art, head support devices are well-suited for their intended purposes but none has the unique features of height adjustability, head size adjustability, vertical and horizontal stability to properly maintain a face-down position while sleeping or while awake, and, most importantly, ease and comfort of use. Since the present invention is worn around the head, not around the face, no pulling or pressure is being exerted at or near to the surgery site as it is in most of the prior art devices.

The head support of the present invention encompasses all these features and more.

Accordingly, several objects and advantages of my invention are to:

a. comfortably accommodate a user's head for medically mandated face-down positions;

b. properly maintain a face-down position by ensuring vertical and horizontal stability of the device on the user's head;

c. accommodate small, medium, and large head sizes by having an adjustable head size feature;

d. provide for height adjustment so that a user can find the correct height level for comfortable use while maintaining a face-down position;

e. be in a face-down position and be able to drink, to read, or to engage in other activities which require a separation or distance range from a user's mouth, nose, or eyes and the object of the activity; and f. provide for an easy-to-manufacture and easy-to-use head support device which is low in cost to produce and to purchase.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a medically-oriented head support designed to maintain a face-down position for a user. The head support is wearable like a hat, has a removable liner, is cushioned for head and eye support and protection, is adjustable to head size, is adjustable to height in use, is securely retainable on a user's head, and is adapted to prevent side to side rocking or tipping over.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
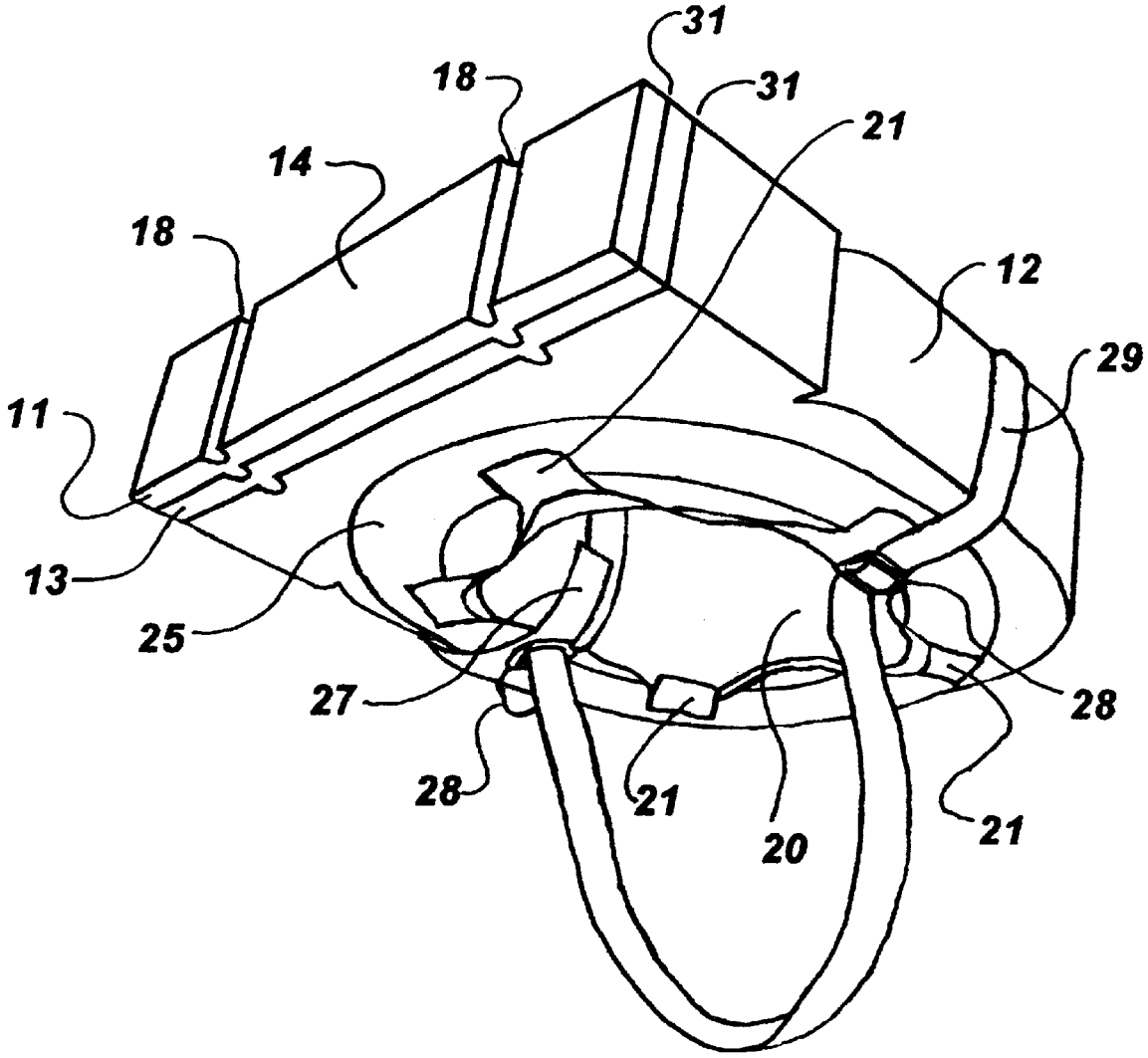
FIG. 1 is a perspective view of the head support.

Referring now to the drawings in detail and in particular to FIG. 1, reference character 10 generally designates a head support constructed in accordance with a preferred embodiment of the present invention. In the discussion to follow reference will be made to FIGS. 1 through 3. The head support 10 has a body 12 with a base 14 and an orifice 16 extending through the top surface to the bottom surface of the body 12. The orifice 16 is adapted to accommodate the head of a user. A user would have the base 14 facing forward and place the head support 10 over and onto the user's head with the head being placed into the orifice 16 (much like putting on a hat). The head support 10 generally is constructed of a resilient or foam-like material. As such, the orifice 16 generally can accommodate any size head and still be sufficiently rigid or tight or both to provide and maintain the face-down position necessary.

Figure 2:
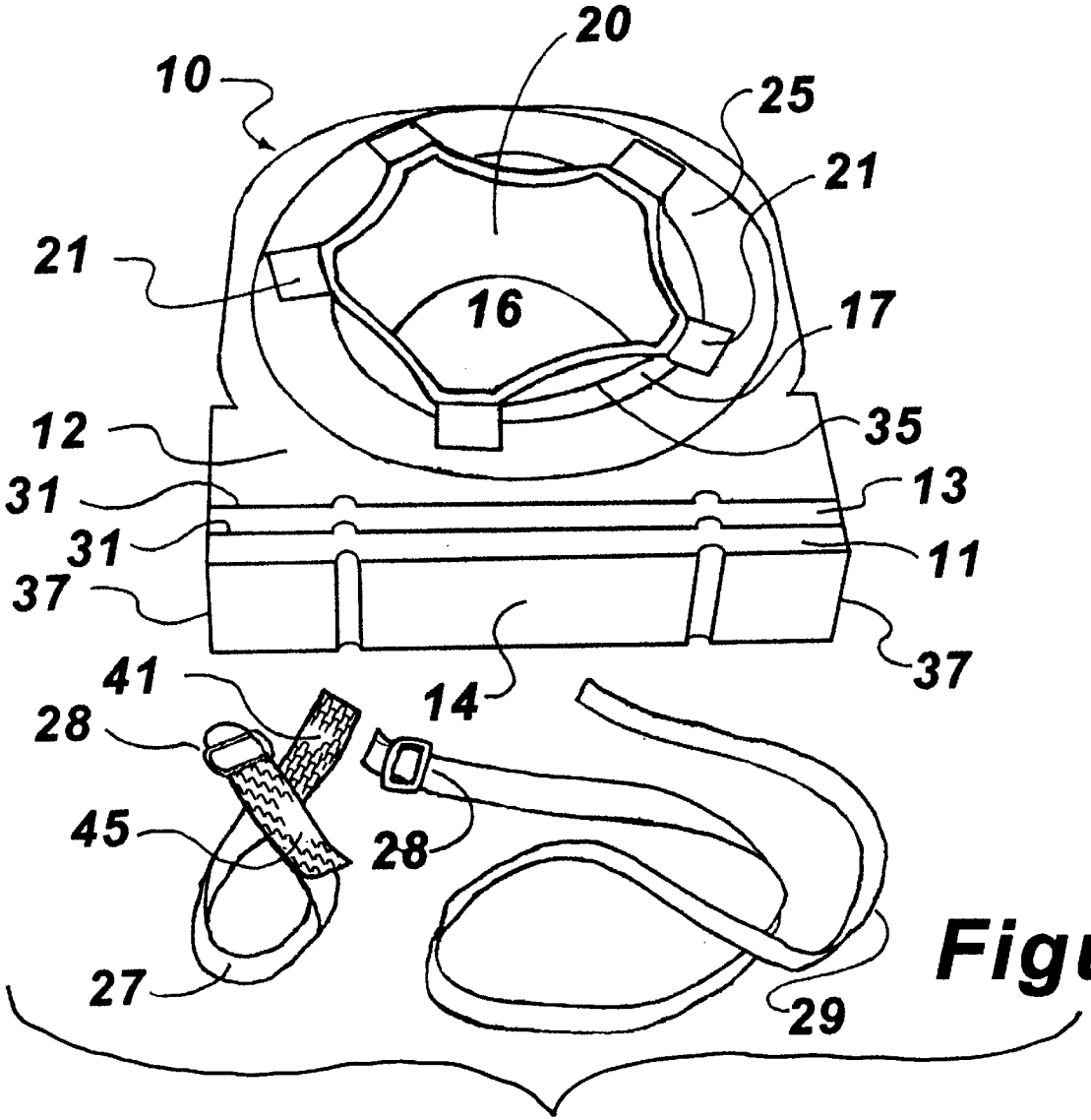
FIG. 2 is a partially exploded front perspective view of the head support.

The base 14 is flat and has two defined corners 37 on both ends. Inward from the corners 37 are one or more dimples or channels 18, the function of which shall be described later. Removable chin straps 27, 29 are on each side of the body 12. They each encircle their side portion of the body and pass through the orifice 16. These chin straps 27, 29, after being fitted onto the body 12 are then connected to one another at the buckle 28 and are then at or under the user's chin. The straps 27, 29 are adjusted and tightened through and at the buckle 28 to provide a comfortable and stable fit of the head support 10 on the user's head. FIG. 2 best illustrates that one strap is shorter than the other strap though each may be of equal length. In this figure, the two straps 27, 29 are not attached to the body 12.

For illustration purposes only reference character 27 is the shorter strap and reference character 29 is the longer strap. Short strap 27 is wrapped (looped) around the body side through the orifice 16 at a place near to a user's ears and fastened to itself. After being fastened in place thereat, the buckle 28 should be on the underside of the head support 10. Any fastening mechanism suited for the intended purpose may be used, including, but not limited to, cooperating hook-and-loop fasteners on opposing sides of the short strap 27, cooperating snaps on opposing sides of the short strap 27, a second securing buckle on the short strap 27, and the like. Preferred is cooperating hook-and-loop fasteners on opposing sides of the short strap 27 such that, after the short strap 27 is wrapped around the body side of the head support 10, one of its ends has a fastener which is adapted to fasten onto any of the outer exposed surfaces of the short strap 27 which have the corresponding fastener to accept and fasten thereto that end of the short strap 27. For illustration purposes, the 'hook' part of this fastener is illustrated as reference character 45 and the 'loop' part is illustrated as reference character 41. This facilitates its connection to, and removal from, the head support 10 as necessary and further facilitates proper positioning of the buckle 28.

The long strap 29 is wrapped around the body 12 on the opposite side near the user's ear on that side. This long strap 29 also has a buckle which serves to create the loop around that side of the body 12. Typically, a user would wrap the loose end of the long strap 29 around the side of the body 12 and bring that loose end to the buckle 28 on the other end of that long strap 29; or, if without a buckle, it could be tied thereat. Then the user would insert that loose end through that buckle 28 and pull it through that buckle 28. The loose end would then be joined to the buckle 28 of the short strap 27, inserted in the buckle 28 of the short strap 27 and comfortably adjusted to fit and then tightened to securely retain the head support 10 onto the head of a user.

As described herein the straps 27, 29 are chin straps and are removable. It must be understood that the straps 27, 29 may also be permanently affixed to the head support 10 and have a suitable connecting mechanism to connect the two straps 27, 29 together so that the head support 10 may be securely retainable on a user's head. The connecting mechanism may be the buckle 28 as described, may be naked loose ends which are tie-able to one another, may be cooperating hook-and-loop fasteners, may be cooperating snaps, or may be cooperating hook-and-eye fasteners, and the like. It is best that the connecting mechanism be adjustable to the user so that a comfortable, as well as a secure, fit may be established. The connecting mechanism must be fashioned such that it will securely maintain the head support on the user's head; particularly when the user is sleeping and may be subject to involuntary and/or aggressive body movements. Maintaining the head support 10 on one's head and maintaining a proper face-down position is very important to post-operative care and maintenance. The straps 27, 29 may be around the body side as described above or may be around the body side and tucked securely into the indents 39 on each side of the body 12 for proper registration and even better holding support of the chin straps 27, 29 on the body 12. Although several connecting mechanisms have been described, use of the buckle 28 or its equivalent is best for adjustability purposes and for securely retaining the head support 10 on the user's head under virtually all circumstances. This is true regardless of whether the straps 27, 29 are removable, as preferred, or non-removable.

Since it is best that the head support 10 be made of resilient or foam-like materials, wearing it on a longer term basis, particularly while sleeping may render wearing it uncomfortable for the user and possibly unsanitary. Perspiration would saturate the head support 10, would soil it, would discolor it, and ultimately could emit unpleasant odors or cause an allergic reaction or otherwise irritate the skin from prolonged use and exposure. To obviate these incidents, I have devised a liner 20 to cover the inner sides of the body 12 in the orifice 16. The liner 20 generally should be of a soft comfortable material and generally should be of a moisture-absorbent material such as, but not limited to, cotton or terry cloth, to absorb perspiration—any absorbent material suited for the intended purpose will suffice. The liner 20 also may be permanently affixed therein by any suitable conventional affixing mechanism or it may be removable. It is preferred that the liner 20 be removable primarily for added comfort and for sanitary reasons.

Figure 3:
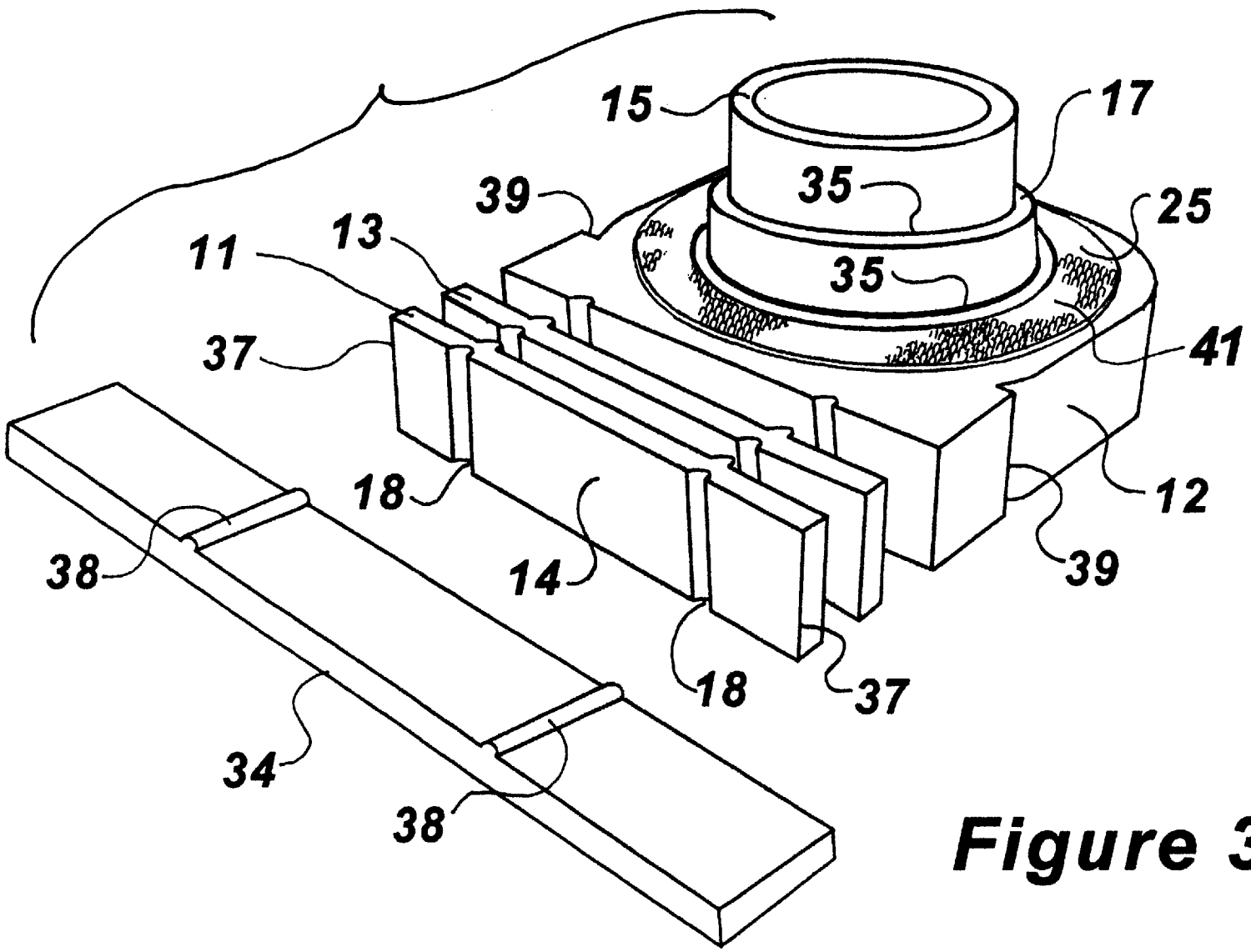
FIG. 3 is an exploded view of the head support.
Figure 4:
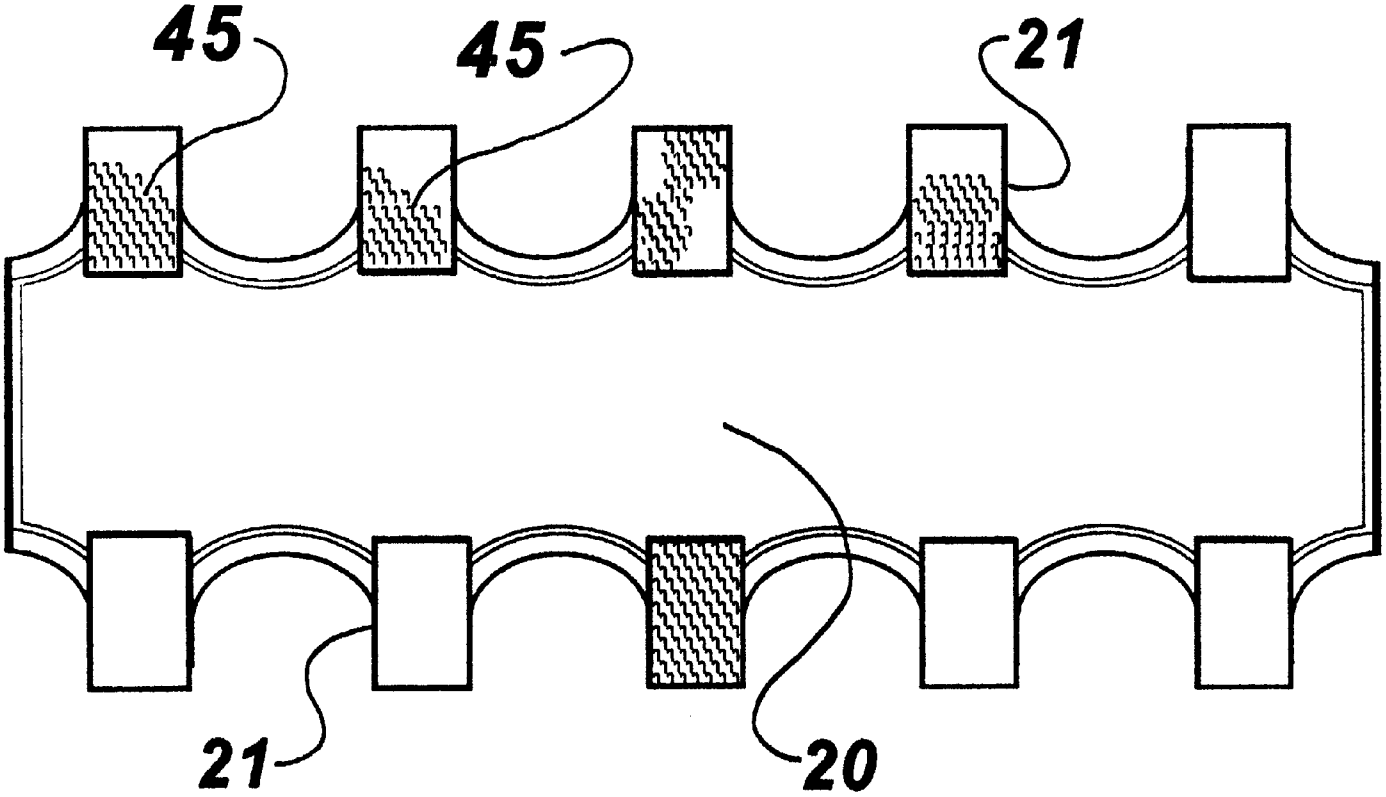
FIG. 4 is a detailed view of the removable liner of the head support.

The liner 20 is illustrated in detail in FIG. 4. It is generally an elongated single-piece liner having multiple liner straps on both long sides of the liner 20 which serve as connectors or fasteners 21 for the liner 20 into the orifice 16. After the liner 20 is fitted into the orifice 16, these liner strap fasteners 21 are attachable to a corresponding fastener 25 on the top surface and on the bottom surface of the head support 10 around the orifice 16. FIGS. 1 and 2 illustrate the corresponding fastener 25 on the top and FIG. 3 illustrates this corresponding fastener 25 on the bottom. Each corresponding fastener 25 is ring-like around the orifice 16 but it need not be. The corresponding fastener 25 may consist of multiple corresponding fasteners equal in number to the number of liner strap fasteners 21. It must be understood that any fastening mechanisms may be used (such as those described earlier which are incorporated by reference herein) but that the hook-and-loop are better suited for simplicity of use and ease of care. It is also best that the corresponding fastener 25 generally be a complete ring-like structure around the orifice 16. This also simplifies manufacture, attachment, removal, and use.

Since the head support 10 is meant to accommodate and maintain a face-down position, to further enhance a user's comfort in this position, I have designed the head support from light-weight cushion-like material which is also somewhat firm or rigid. This provides a cushion for the forehead when the head support 10 is worn and the user is in a face-down position. Since it is worn around one's head, with the pressure being applied to the forehead when in a face-down position, no pressure is being exerted at or near to the eye which underwent surgery or to any dressing thereat.

Adjustability as to height and as to head size is another important feature of the present invention. FIG. 3 best illustrates the adjustability as to both. The front of the head support 10 has two or more removable base sections 11, 13. These are removable at the base score-lines 31 as illustrated in FIG. 2. In this regard, when the head support 10 is constructed, it is constructed with the base scored with these base score-lines 31 which are adapted to hold the base sections 11, 13 firmly onto the head support 10 but yet to permit removal of one or both base sections 11, 13 as needed for pre-use or in-use height adjustability.

Similarly, FIG. 3 illustrates the head size adjustability feature. Here it shows two removable crown sections 15, 17 partially removed and telescoping from the body 12. These are removable at the crown score-lines 35 as illustrated in FIG. 3. As in the base sections, when the head support 10 is constructed, it is constructed with crown score-lines 35 which are adapted to hold the crown sections 15, 17 firmly onto the head support 10 in the orifice 16 but yet to permit removal of one or both crown sections 15, 17 as needed depending on a user's head size. Leaving both in place generally is best suited for a small head size, removing the first crown section 15 will more comfortably accommodate a person with a medium head size. Removing the second crown section 17 will more comfortably accommodate a person with a larger head size. It must be understood that the head support 10 may have less than two removable base sections and crown sections or may have more than two removable base sections and crown sections. Two of each such removable sections, however, accommodates most users and their needs. In any event, corresponding fastener 25 does not encroach upon the crown sections 15, 17 to prevent the removal of the crown sections or to make their removal more difficult.

As mentioned earlier, the base 14 is the front of the head support 10 and forms the first removable base section 11. It has one or more dimples or channels 18 transversing its length from top surface to bottom surface. Each succeeding removable base section, such as base section 13, as well as the front body 12 after all removable base sections 11, 13, have been removed also has one or more dimples or channels 18 running from top surface to bottom surface. These dimples 18 are a feature to accommodate a base support member 34 which has nubs (ridges or protrusions) 38 corresponding to the dimples 18 and fitted therein as needed. The base support member 34 generally is wider than the width of the base 14 and extends there beyond. As mentioned earlier, the base 14 has well-defined corners 37. The function of the corners 37 is to prevent the head support 10, when worn by a sleeping user, from rocking over left or right and/or falling over on its side. In those cases where a particularly aggressive sleeper is wearing the head support 10 and the corners 37 are ineffective in preventing this rocking and/or falling over, the base support member 34 will. The respective channels 18 and ridges 38 also prevent sliding or lateral translation of the base support member 34.

The present disclosure includes that contained in the present claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention. Accordingly, the scope of the invention should be determined not by the embodiment[s] illustrated, but by the appended claims and their legal equivalents.

The invention claimed is:

1. A head support comprising:

(a) a body having a front side, a top surface, a bottom surface, a base at said front side, a back side, and an orifice, said orifice transversing said body from the top surface to the bottom surface and having a opening approximately equal in width from the top surface through to the bottom surface defining an inner surface therein with walls approximately parallel to said front side and said back side adapted to accommodate wearing said head support around a person's head;

(b) a liner covering said inner surface of said orifice, said liner removably attachable to the body;

(c) crown adjustment means for adjusting the width of said opening of said orifice; and (d) a base support member attachable to said base, said base support member having a first side and a second side each of which laterally extend beyond said base to provide vertical stability to said head support.

2. The head support as defined in claim 1 wherein said crown adjustment means comprises one or more removable sections from said orifice thereby increasing the width of said opening of said orifice.

3. The head support as defined in claim 1 further comprising base adjustment means for adjusting the length of said body.

4. The head support as defined in claim 3 wherein said base adjustment means comprises one or more sections removable from said base.

5. The head support as defined in claim 1 further comprising fastening means for removably attaching said liner to said body.

6. The head support as defined in claim 5 wherein said fastening means comprises one or more liner straps extending from said liner, each of said one or more liner straps having a fastener thereon; and a cooperating fastener on said body for receiving and retaining the fastener of said one or more liner straps.

7. The head support as defined in claim 6 wherein said fastener of said one or more liner straps is one element of a hook-and-loop fastener and said cooperating fastener is another element of a hook-and-loop fastener.

8. The head support as defined in claim 7 wherein said cooperating fastener encircles said orifice on the top surface and on the bottom surface of said body.

9. The head support as defined in claim 1 further comprising retaining means for retaining said head support onto a person's head.

10. The head support as defined in claim 9 wherein said retaining means comprises one or more adjustable chin straps on said body.

11. The head support as defined in claim 10 wherein said one or more adjustable chin straps are removably attachable to said body.

12. The head support as defined in claim 11 further comprising a chin strap registration means for registering said one or more chin straps to said body.

13. The head support as defined in claim 1 further comprising a base registration means for registering said base support member to said base.

14. A head support comprising:

(a) a body having a front side, a top surface, a bottom surface, a base at said front side, a back side, and an orifice, said orifice transversing said body from the top surface to the bottom surface and having a opening approximately equal in width from the top surface through to the bottom surface defining an inner surface therein with walls approximately parallel to said front side and said back side adapted to accommodate wearing said head support around a person's head;

(b) a liner covering said inner surface of said orifice, said liner removably attachable to the body;

(c) base adjustment means for adjusting the length of said body from said front side to said back side; and (d) a base support member attachable to said base, said base support member having a first side and a second side each of which laterally extend beyond said base to provide vertical stability to said head support.

15. The head support as defined in claim 14 wherein said base adjustment means comprises one or more sections removable from said base.

16. The head support as defined in claim 14 further comprising crown adjustment means for adjusting the width of said opening of said orifice.

17. The head support as defined in claim 14 wherein said crown adjustment means comprises one or more removable sections from said orifice thereby increasing the width of said opening of said orifice.

18. The head support as defined in claim 14 further comprising fastening means for removably attaching said liner to said body.

19. The head support as defined in claim 18 wherein said fastening means comprises one or more liner straps extending from said liner, each of said one or more liner straps having a fastener thereon; and a cooperating fastener on said body for receiving and retaining the fastener of said one or more liner straps.

20. The head support as defined in claim 19 wherein said fastener of said one or more liner straps is one element of a hook-and-loop fastener and said cooperating fastener is another element of a hook-and-loop fastener.

21. The head support as defined in claim 20 wherein said cooperating fastener encircles said orifice on the top surface and on the bottom surface of said body.

22. The head support as defined in claim 14 further comprising retaining means for retaining said head support onto a person's head.

23. The head support as defined in claim 22 wherein said retaining means comprises one or more adjustable chin straps on said body.

24. The head support as defined in claim 23 wherein said one or more adjustable chin straps are removably attachable to said body.

25. The head support as defined in claim 24 further comprising a chin strap registration means for registering said one or more chin straps to said body.

26. The head support as defined in claim 14 further comprising a base registration means for registering said base support member to said base.

* * * * *